US005129210A

United States Patent [19]

Cicatello et al.

[11] Patent Number: 5,129,210

[45] Date of Patent: Jul. 14, 1992

[54] CLAMPING AND CUT-OFF APPARATUS FOR A BANDING STRAP

[75] Inventors: Samuel Cicatello, East Amherst; Robert M. Macartney; Warren L. Gawve, both of Lockport, all of N.Y.

[73] Assignee: General Motors Corporation, Detroit, Mich.

[21] Appl. No.: 709,515

[22] Filed: Jun. 3, 1991

[51] Int. Cl.[5] ..... B65B 11/00; B65B 67/08

[52] U.S. Cl. ..... 53/138.1; 53/582; 53/592

[58] Field of Search ..... 53/582, 592, 589, 590, 53/138.1; 83/698; 100/10, 33 R, 33 PB; 140/93.2, 93.4; 493/390

[56] References Cited

U.S. PATENT DOCUMENTS

| | | | |
|---|---|---|---|
| 3,291,163 | 12/1966 | Timmerbeil | 100/33 R |
| 3,418,875 | 12/1968 | Friedman | 83/698 X |
| 3,442,732 | 5/1969 | Stensaker et al. | 53/582 X |
| 3,442,733 | 5/1969 | Viccins | 53/592 X |
| 3,442,734 | 5/1969 | Ericsson | 53/592 X |
| 3,914,153 | 10/1975 | Sato | 53/582 X |
| 3,929,172 | 12/1975 | Sansum | 140/93.2 |

FOREIGN PATENT DOCUMENTS

| | | | |
|---|---|---|---|
| 482787 | 4/1938 | United Kingdom | 140/93.4 |

*Primary Examiner*—John Sipos
*Assistant Examiner*—Linda B. Johnson
*Attorney, Agent, or Firm*—Ronald L. Phillips

[57] ABSTRACT

A clamping and cut-off apparatus for a banding strap around an object, including a convex shaped knife and a concave shaped cutting member operable to cut an arcuate shape in a banding strap which has been initially fed intermediate the edges of the concave shaped cutting member and the convex shaped knife and thence around an object. Crimping members are reciprocally and pivotally mounted in the housing adjacent the clamping member to seal together overlapping portions of the strap just prior to the cutting operation. The bottom portion of the housing is slidably removed from between the sealed and cut strap and the external banded object.

8 Claims, 7 Drawing Sheets

CLAMPING AND CUT-OFF APPARATUS FOR A BANDING STRAP

TECHNICAL FIELD

This invention relates generally to feeding and cutting arrangements for wrapping a metal strap tightly around an item to be banded and, more particularly, to the clamping and cut-off apparatus thereof.

BACKGROUND ART

Heretofore, it has been common practice, along with feeding, tensioning, and crimping a metal strap around an item being banded, to cut the strap with a straight shear. As a result, sharp edges on the end of the strap have a natural tendency to catch on a corner or crevice, causing the strap to "jam" in a track or along a passageway through which it is being fed.

DISCLOSURE OF THE INVENTION

A general object of the invention is to provide an improved clamping and cut-off device for a metal strap serving to wrap tightly around an item to be banded.

Another object of the invention is to provide a clamping and cut-off assembly for a metal strap for banding an object, wherein the cut-off components eliminate sharp corners or edges on the end of the cut strap that may cause the strap to jam while being fed.

A further object of the invention is to provide a clamping and cut-off assembly for a metal banding strap, wherein the cut-off components sever the end of the band to a predetermined radius, thereby eliminating sharp corners or edges thereon.

Still another object of the invention is to provide a clamping and cut-off assembly including a housing, a convex shaped knife fixedly secured in the housing, a concave shaped cutting member reciprocally mounted in the housing, clamping members pivotally mounted in the housing, and a tandem cylinder arrangement for pivoting the clamping members to clamp the end portion of a strap against a serrated surface of the convex shaped knife, which has been initially fed intermediate the edges of the concave shaped cutting member and the convex shaped knife and thence around an object to be banded and back into the housing.

These and other objects and advantages will become more apparent when reference is made to the following drawings and the accompanying description.

BEST MODE FOR CARRYING OUT THE INVENTION

Figure 1:
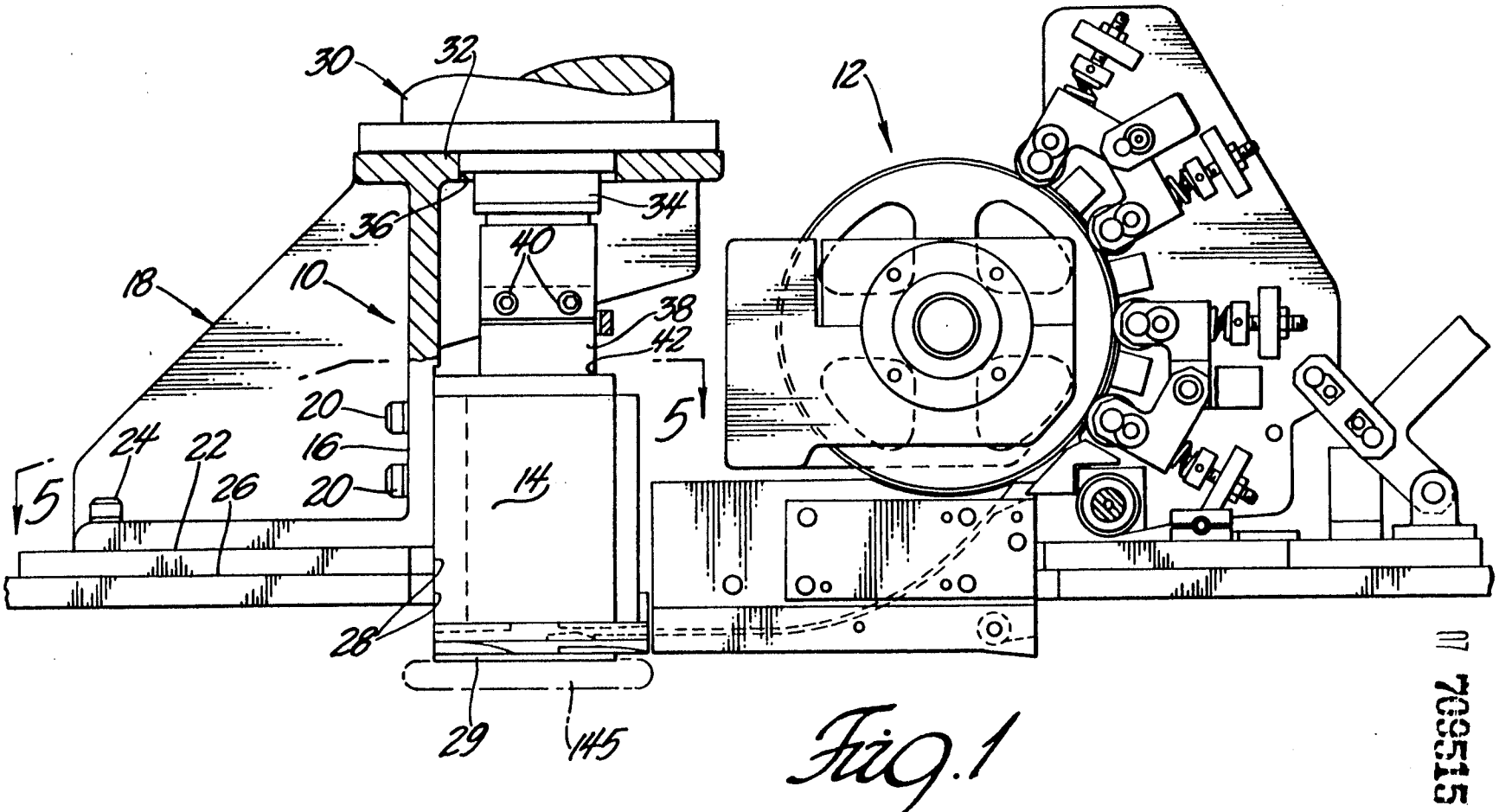
FIG. 1 is a front elevational view of a strap feed and cut-off assembly embodying the present invention.

Referring now to the drawings in greater detail, FIG. 1 illustrates a clamping and cut-off assembly 10, which may be operatively connected to a strap feed assembly 12. The latter forms no part of the present invention, and is shown and described in detail in co-pending U.S. application Ser. No. 670,625, which is assigned to an assignee common to the assignee of this application.

In accordance with the present invention, the clamping and cut-off assembly 10 includes a housing 14 secured to a wall 16 of a casting 18 by suitable cap screws 20. The casting 18 is mounted on a baseplate 22, and secured thereto by suitable cap screws 24. The baseplate 22, in turn, is mounted on a platform 26. The bottom portion of the housing 14 extends downwardly through an opening 28 formed through the baseplate 22 and the platform 26. A floor 29 is formed across the bottom of the housing 14 for a purpose to be described.

A tandem cylinder assembly 30 is mounted on top of a top horizontal plate portion 32 of the casting 18. A piston 34 extends downwardly from the cylinder assembly 30, through an opening 36 formed in the plate portion 32.

A square cross-sectional drive member 38 is secured to the piston 34 by any suitable means, such as cap screws 40. The drive member 38 extends into a square cross-sectioned opening 42 in the housing 14, for reciprocal movement therein. The square opening 42 is formed by recesses 44 and 46 (FIG. 5) formed in respective, oppositely disposed wall members 48 and 50 within the housing 14.

Figure 2:
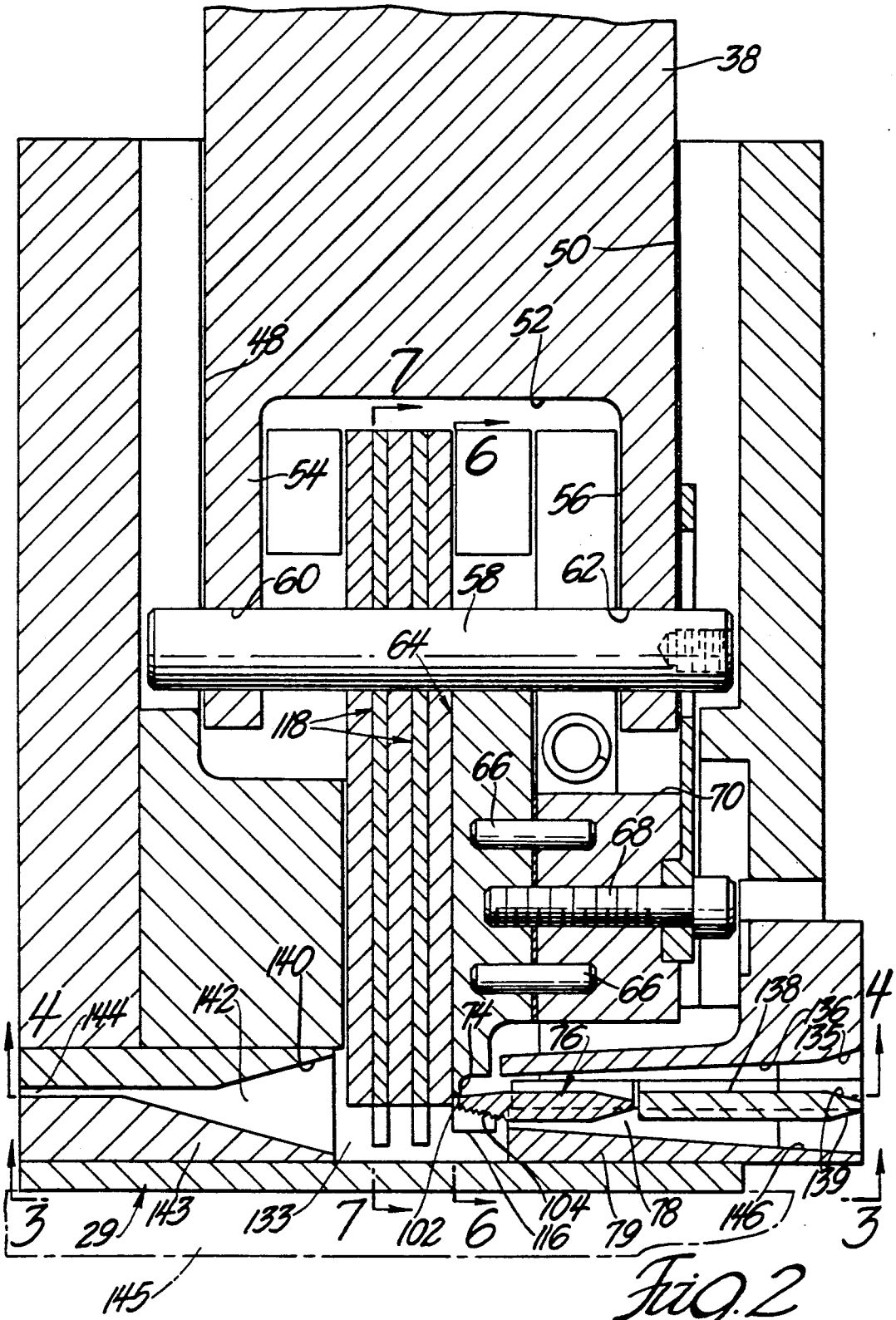
FIG. 2 is a cross sectional view of the clamping and cut-off portion of the FIG. 1 structure with the front cover removed.

As shown in FIG. 2, an inverted U-shaped cavity 52 is formed through the bottom of the drive member 38, defining walls 54 and 56 adjacent the respective wall members 48 and 50. A pin member 58 is mounted through aligned openings 60 and 62 formed through the respective walls 54 and 56 for reciprocal movement therewith.

Figure 8:
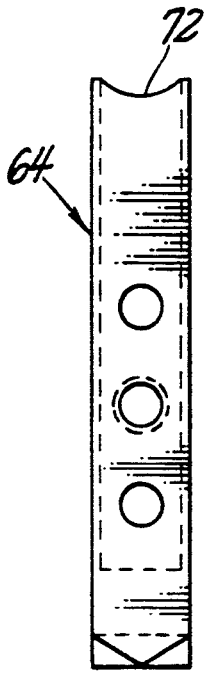
FIGS. 8, 9 and 10 are respective front, side and bottom views of a moveable concave cutting member of the FIGS. 6 and 6A structure.

A cutting member 64 is secured in a vertical orientation by suitable dowels 66 and a cap screw 68 to a movable member 70 within the housing 14. As shown in FIG. 8, the cutting member 64 has an arcuate depression 72 formed in the top end thereof. The arcuate depression 72 is sized so as to partially wrap around the pin member 58 of FIG. 2. A concave cutting edge 74 is formed on the bottom end of the cutting member 64 (FIG. (10).

Figure 4:
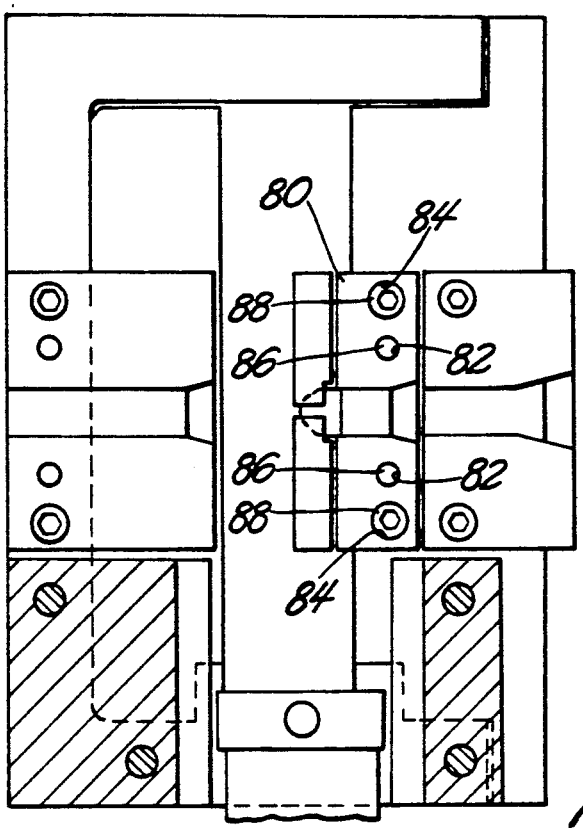
FIGS. 3 and 4 are cross-sectional views taken along the respective planes 3—3 and 4—4 of FIG. 2, and looking in the direction of the arrows.
Figure 3:
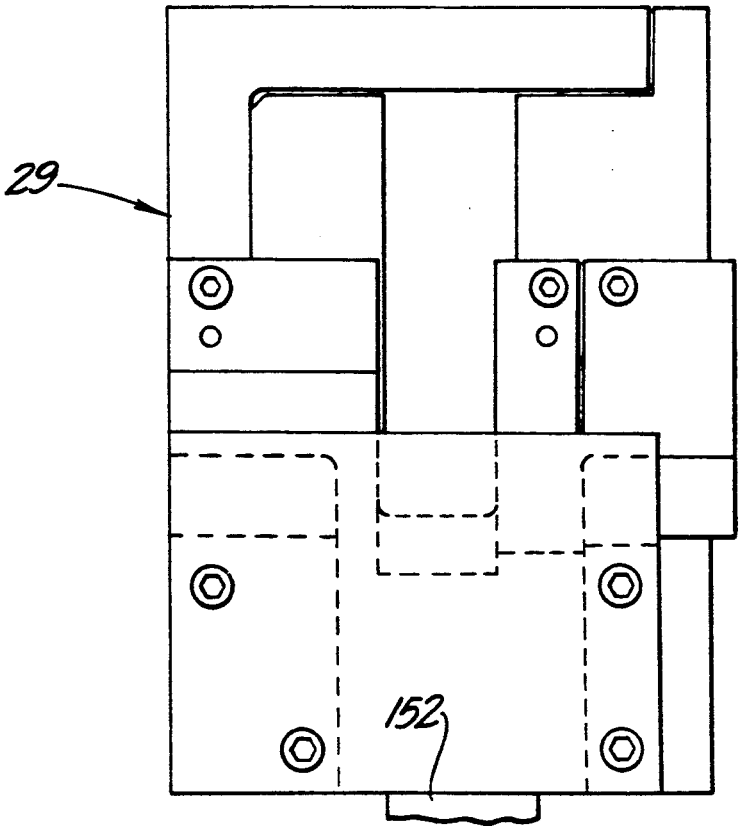
Figure 9:
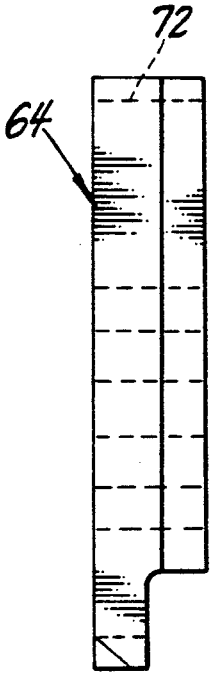
Figure 10:
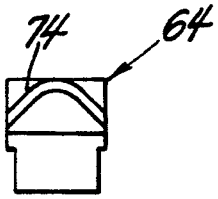
Figure 11:
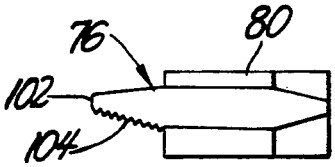
FIGS. 11, 12 and 13 are respective front, bottom and end views of a convex stationary knife of the FIG. 2 structure.
Figure 12:
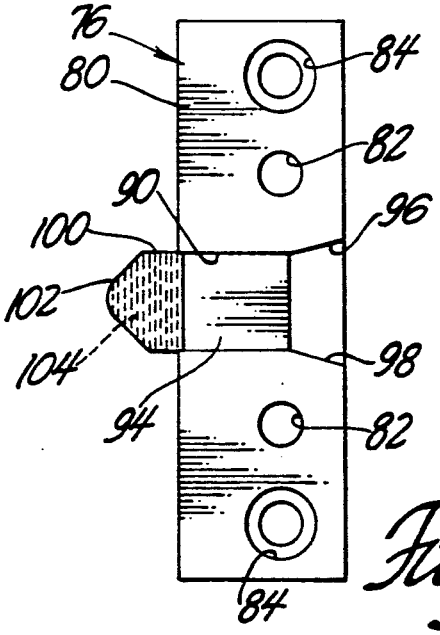
Figure 13:
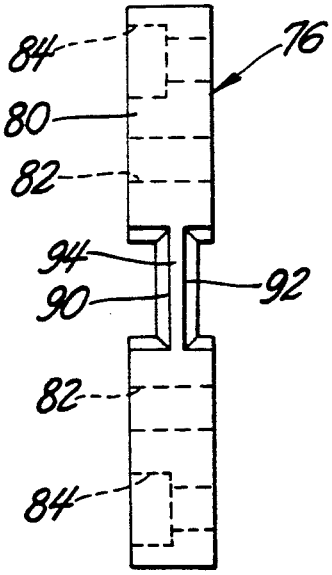

Referring once again to FIG. 2, a knife assembly 76 is fixedly secured within a lateral passageway 78 formed above a tapered strip 79 secured to the right end of the floor 29 in FIG. 2. The preferred knife assembly 76 is best seen in FIGS. 11–13 to consist of a block 80 of a predetermined thickness, with pairs of holes 82 and 84 formed therethrough for respective dowels 86 and cap screw 88 (FIG. 4) to secure the assembly to the housing 14. Oppositely disposed recesses 90 and 92 (FIG. 13) are formed across the center portion of the block 80, defining a center strip 94. Flared opening edges 96 and 98 (FIG. 12) are formed on the respective recesses 90 and 92. As seen in FIGS. 11 and 12, the center strip 94 includes an extension 100 beyond the side of the block 80 opposite the flared edges 96 and 98. The extension 100 is formed to include a convex shaped end surface 102. As seen in FIG. 2, the convex shaped end surface 102 is positioned so as to be immediately adjacent the plane of the concave cutting edge 74 of the movable cutting member 64 (FIGS. 8–10). A knurled tapered bottom surface 104 (FIGS. 11 and 12) is formed on the extension 100 from the convex shaped end surface 102 to a line just past the face of the block 80.

Figure 6:
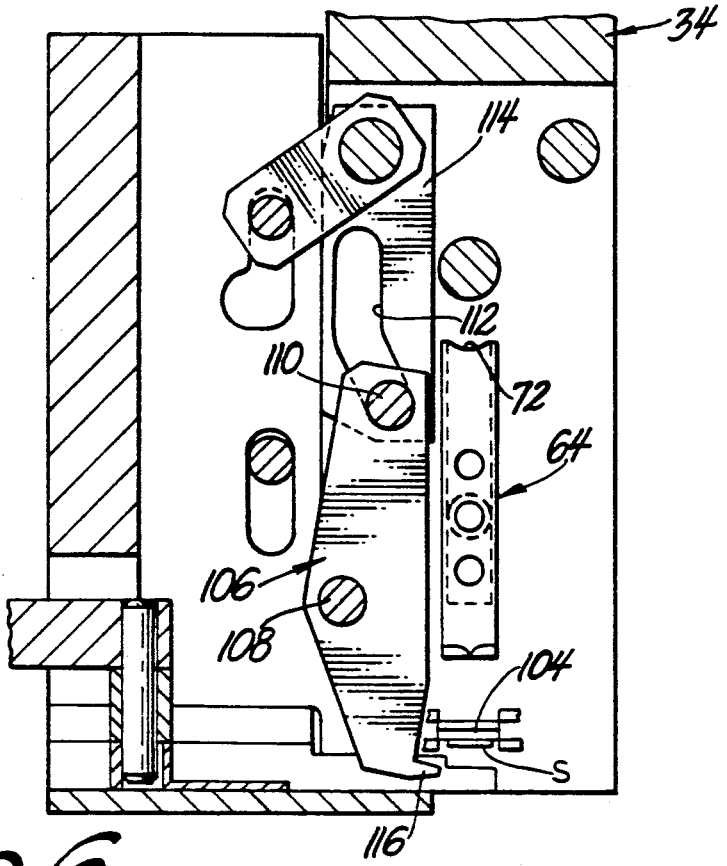
FIG. 6 is a cross-sectional view taken along the plane of the line 6—6 of FIG. 2, and looking in the direction of the arrows.
Figure 6A:
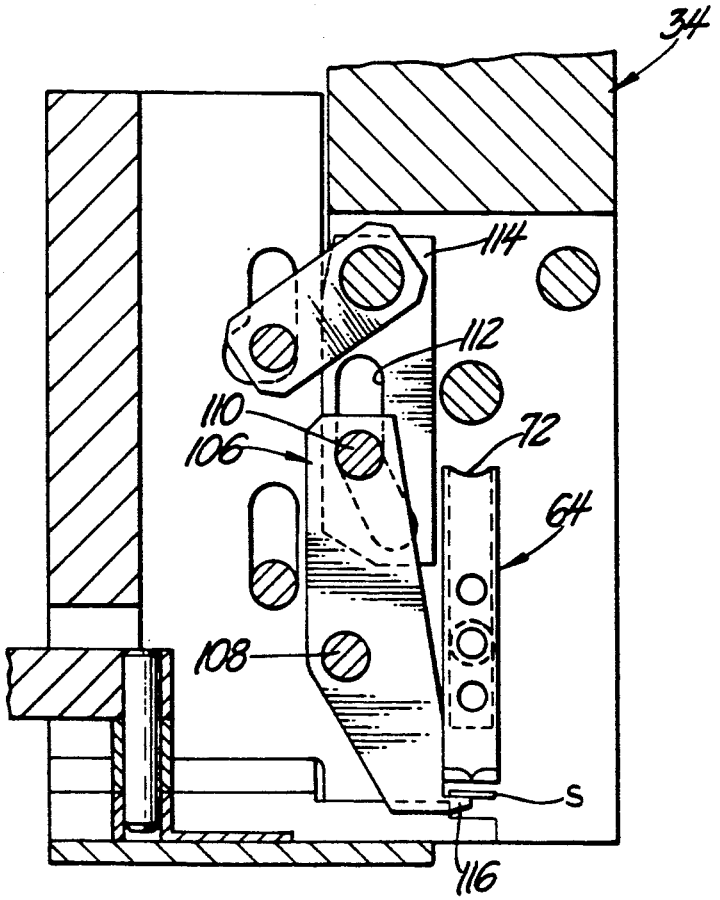
FIG. 6A is a view view similar to FIG. 6, showing the components thereof in a different operational position.

As shown in FIGS. 6 and 6A, a clamping member 106 is pivotally mounted on a dowel 108 at a midpoint thereof, with a dowel 110 through the upper end thereof slidably mounted in a "dog leg" shaped slot 112 formed in an extension 114 of the piston 34. A clamp finger 116 formed on the lower end of the clamping member 106 is shown in FIG. 6 as being in a retracted position so as to allow a strap S to slidably pass beneath the knurled tapered bottom surface 104 of the extension 100 when the strap is being moved through the passageway 78 by the strap feed assembly 12 after having been wrapped around selected items or objects on an adjacent conveyor line (not shown). As the piston 34 and the associated extension 114 move downwardly, upon the firing of the first stage of the tandem cylinder assembly 30, as shown in FIG. 6A, the clamp finger 116 is pivoted upwardly to abut against the strap adjacent the knurled surface 104 to clamp the strap S therebetween (FIG. 2).

It is to be realized that, while only one clamping member 106 is shown in FIGS. 6 and 6A, there is a duplicate, mirror image clamping member (not shown) to the right of the cutting member 64 in the FIGS. Hence, the strap S is engaged from both sides of its center line, as is evident in FIG. 6A.

Figure 7:
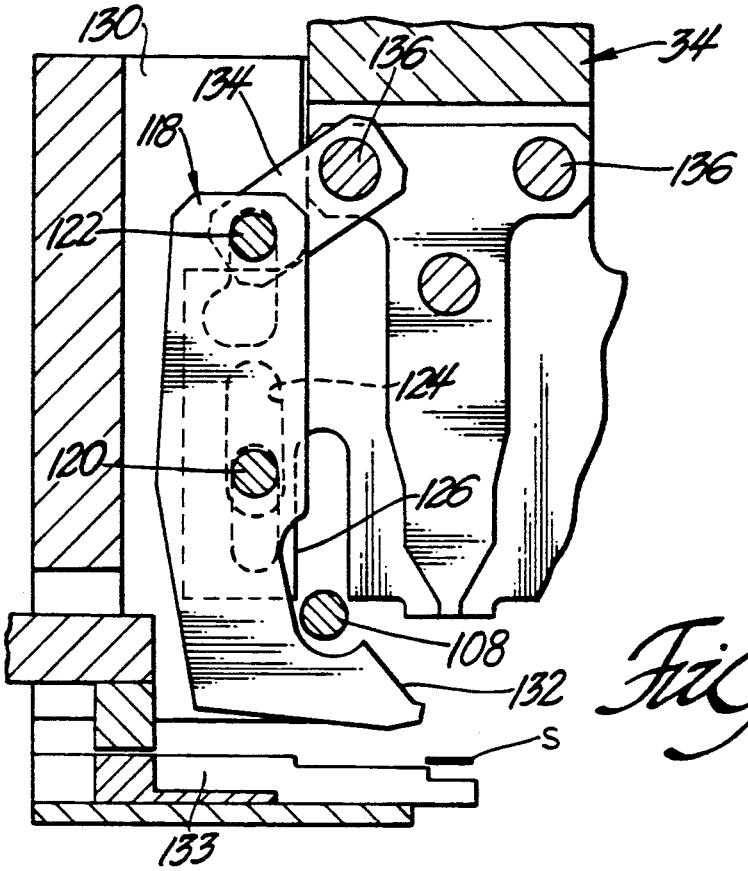
FIG. 7 is a cross-sectional view taken along the plane of the line 7—7 of FIG. 2, and looking in the direction of the arrows.
Figure 7A:
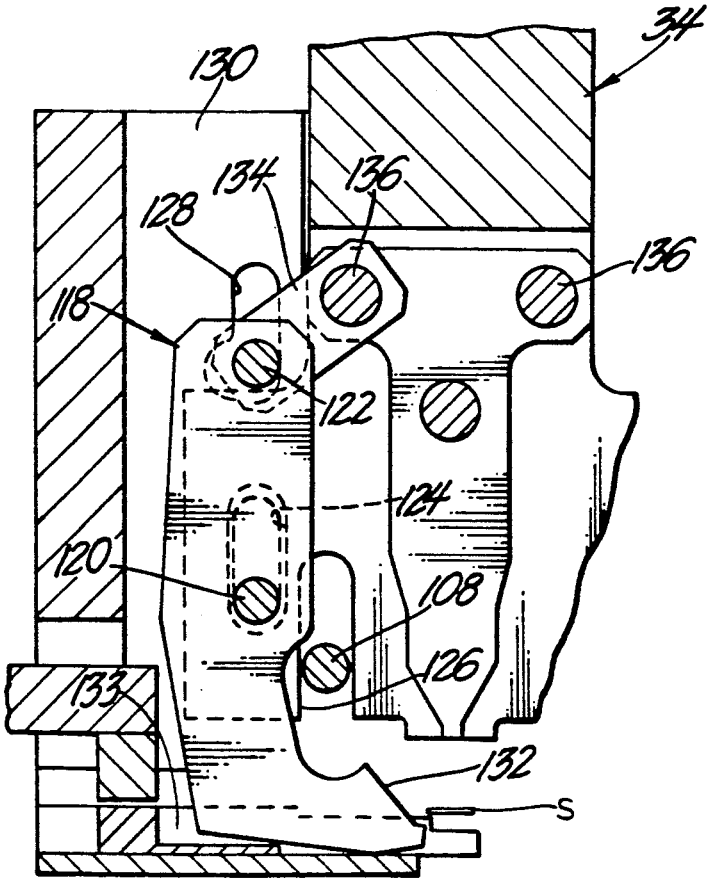
FIG. 7A is a view similar to FIG. 7 showing the components thereof in a different operational position.

As shown in FIGS. 7 and 7A, a crimping member 118 is slidably and pivotally mounted within the housing 14 by virtue of two dowels 120 and 122 fixedly secured through central and upper end portions, respectively, of the member 118. The dowel 120 extends into a vertical guide slot 124 formed in a vertically movable member 126, and the dowel 122 extends into a reverse L-shaped slot 128 formed in a fixed member 130. A tapered crimp finger 132 is formed on the lower end of the crimping member 118. As may be noted in FIG. 2, there are two spaced apart crimping members 118 adapted to extend downwardly into a space 133 above the floor 29.

As was the case for FIGS. 6 and 6A, it is to be realized that, while only one crimping member 118 is shown in FIGS. 7 and 7A, and two members 118 are evident in FIG. 2 in a side-by-side relationship, a second pair of side-by-side crimping members (not shown) are positioned on the right side of FIGS. 7 and 7A as mirror images of the member shown, serving to crimp the strap S from both sides at the two locations.

A link 134 extends between each dowel 122 and a dowel 136 secured to the piston 34, such that the dowel 122 and, hence, the associated crimping member 118 are pushed downwardly into the space 133 until the dowel 120 reaches the bottom of the vertical guide slot 124, upon the firing of the first stage of the tandem cylinder assembly 30. This action brings th crimp fingers 132 into position adjacent the two overlapped strap S segments, as shown in FIG. 7A.

It should be noted that the strap S is initially moved by a servomotor of the strap feed assembly 12 into a tapered inlet 135 into an upper passageway 136 above a spacer member 138 having a chamfered upper and lower end 139, past the upper surface of the knife assembly 76, above the clamp finger 116 and above the crimp fingers 132, into a tapered inlet 140 into a passageway 142 formed by a second tapered strip 143 secured to the left end of the floor 29, in FIG. 2, and out an exit 144. From there, the strap S is fed by the servomotor of the feed assembly 12 and directed by any suitable track or guide means around an object 145 to be banded, such as a radiator or heater core, and thence through a lower opening 146 into the passageway 78 back into the housing 14, past the bottom surfaces of the spacer member 138 and the knife assembly 76 to underlap the upper strap beyond the knife assembly, across the space 133, to approximately the entrance of the passageway 142. It is at this point that the above described clamping of the end of the strap S occurs. Thereafter, the servomotor is reversed to pull the strap S back through the upper passageway 136 to thereby tension the strap tightly around the object 145 being banded external of the housing 14.

Upon the firing of the second stage of the tandem cylinder assembly 30, the concave cutting edge 74 cuts through the upper strap S adjacent the convex shaped end surface 102 of the extension 100 of the knife assembly 76, as may be realized from the relative positions of the elements 74 and 102 in FIG. 2. Concurrently, each of the tapered crimping fingers 132 serve to crimp the strap S when the link 134 urges the dowel 122 leftwardly in FIG. 7A to the end of the base of the reverse L-shaped slot 128, to thereby pivot each crimping member 118 about the respective central dowels 120. This crimping action fastens the overlapped strap S segments together to create a seal around the object.

Figure 14:
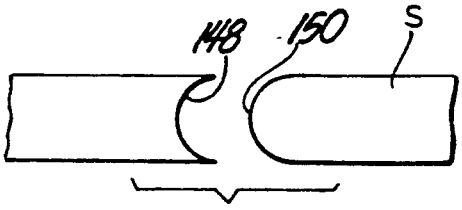
FIG. 14 is a top view of a strap after it has been severed by the cutting member and knife shown in FIGS. 8–13.

As shown in FIG. 14, the severed ends of the strap S include a concave shaped end 148 on the strap S that has been banded around an external object, while the leading end of the strap remaining to be processed during the next cycle is a convex shaped end 150 having no sharp corners or edges that could cause the strap to jam during feeding.

Figure 5:
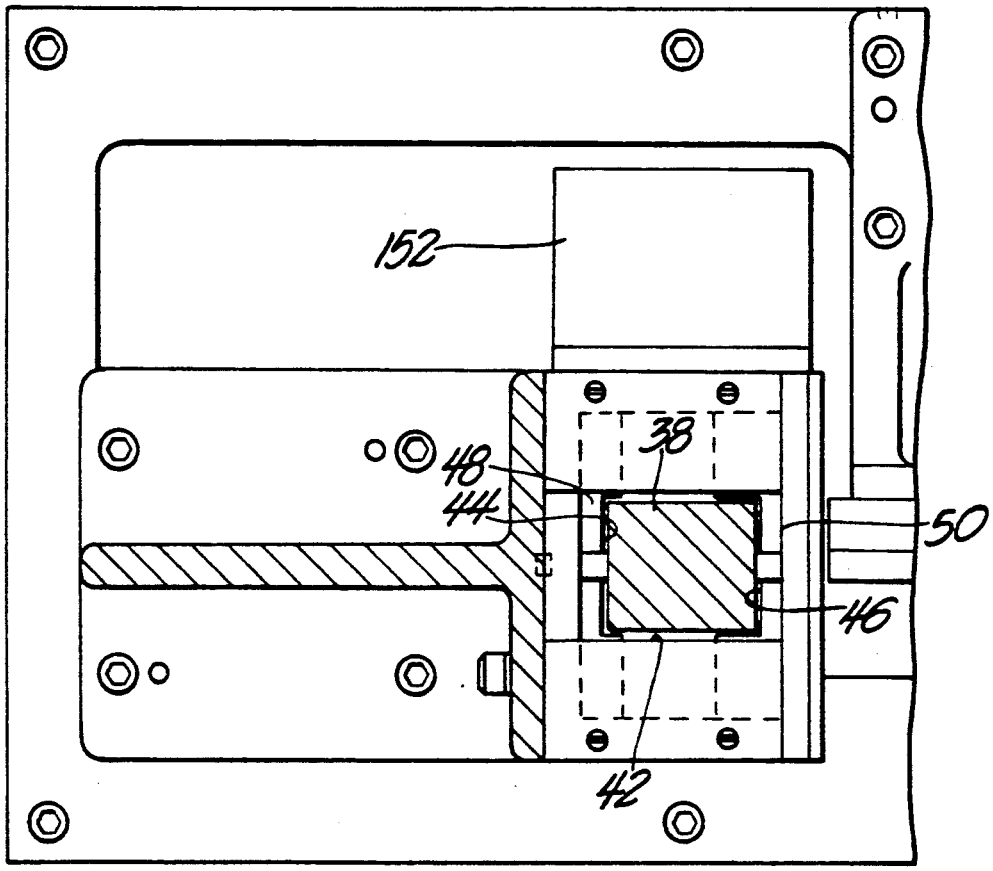
FIG. 5 is a cross-sectional view taken along the plane of the line 5—5 of FIG. 1, and looking in the direction of the arrows.

Immediately after the crimping and cutting of the strap S has been completed, suitable cylinder means, represented at 152 in FIG. 5, and which is operably connected to the floor 29 of the housing 14, and the associated tapered strips 79 and 143, is actuated to withdraw these elements laterally from between the strap S and the object 145. The above described tensioning operation is generally such that the object 145 being banded is required to be relatively close to, but not touching against the bottom surface of the floor 29. This is accomplished through an external clamping arrangement of the object to be banded. Hence, once the floor 29 is withdrawn, there is no resultant slack between the strap S and the object 145.

INDUSTRIAL APPLICABILITY

It should be apparent that the invention provides an improved apparatus for clamping and cutting a metal strap after banding an object, such that the shape of the end of the strap has no sharp corners or edges that could cause jamming during the next feeding cycle.

While but one embodiment of the invention has been shown and described, other modifications thereof are possible within the scope of the following claims.

The embodiments of the invention in which an exclusive property or privilege is claimed are defined as follows:

1. A clamping and cutting apparatus comprising a housing, a knife having an end surface and a knurled side surface formed thereon, said knife being fixedly secured in said housing, a cylinder reciprocally mounted in said housing, a cutting member having an end surface formed thereon, said cutting member being operatively connected to said cylinder with the planes of said respective end surfaces being immediately adjacent one another, clamping means pivotally mounted in said housing and operatively connected to said cylinder for being pivotally actuated thereby to clamp a portion of a free end of a strap against said knurled surface of said knife, after said strap has been initially fed intermediate the respective end surfaces and thence around an object to be banded and back into the housing to overlap a segment of the strap, and at least one crimping member reciprocally and pivotally mounted in said housing, linkage means operatively interconnecting said cylinder and said at least one crimping member, a crimp finger formed on the lower end of said crimping member for crimping and deforming the overlapped segments of said strap, said crimping member adapted to move longitudinally and to pivot into the overlapped segments of said strap to seal same in respone to movement of said cylinder, and said strap being cut apart by the movement of said end surface of said cutting member past said end surface of said knife in response to the movement of said cylinder.

2. The clamping and cutting apparatus described in claim 1, wherein said cylinder means includes a tandem cylinder adaptable to be fired in first and second stages.

3. The clamping and cutting apparatus described in claim 1, wherein said knife is secured in a passageway through said housing above a floor thereof, and second cylinder means operatively connected to said floor and adapted to withdraw said floor to free said strap after being cut apart.

4. The clamping and cutting apparatus described in claim 1, including two crimping member sets spaced apart along the sides of said overlapped segments of said strap.

5. The clamping and cutting apparatus described in claim 1, including fixed oppositely disposed guide members, said cutting member being reciprocally mounted therebetween, an arcuate depression formed in the upper end of said cutting member, a pin member fixedly secured to said cylinder means and seated in said arcuate depression, and fastener means for securing said cutting member to said cylinder means for movement therewith.

6. The clamping and cutting apparatus described in claim 1, wherein said end surface of said knife is convex shaped, the end surface of said cutting member is concave shaped, and said strap is cut in an arcuate shape.

7. The clamping and cutting apparatus described in claim 2, wherein said clamping means clamps said portion of said free end of the strap against said knurled surface, and said at least one crimping member is moved in one reciprocal direction in response to the firing of the first stage of said tandem cylinder.

8. The clamping and cutting apparatus described in claim 2, wherein said at least one crimping member is pivotally moved into said overlapped segments, and said cutting member is moved past said knife in response to the firing of the second stage of said tandem cylinder.

* * * * *